US011963615B2

(12) United States Patent
Schürle et al.

(10) Patent No.: US 11,963,615 B2
(45) Date of Patent: Apr. 23, 2024

(54) SUPPORT PART, CONSTRUCTION KIT FOR PIECE OF FURNITURE, PIECE OF FURNITURE AND CORRESPONDING USE

(71) Applicant: Neoperl GmbH, Müllheim (DE)

(72) Inventors: Holger Schürle, Müllheim (DE); Werner Kury, Müllheim (DE); Werner Bammerlin, Müllheim (DE)

(73) Assignee: NEOPERL GMBH, Mullheim (DE)

( * ) Notice: Subject to any disclaimer, the term of this patent is extended or adjusted under 35 U.S.C. 154(b) by 363 days.

(21) Appl. No.: 17/417,900

(22) PCT Filed: Nov. 7, 2019

(86) PCT No.: PCT/EP2019/080618
§ 371 (c)(1),
(2) Date: Jun. 24, 2021

(87) PCT Pub. No.: WO2020/147995
PCT Pub. Date: Jul. 23, 2020

(65) Prior Publication Data

US 2022/0053935 A1 Feb. 24, 2022

(30) Foreign Application Priority Data

Jan. 16, 2019 (DE) ..... 202019100241.7

(51) Int. Cl.
*A47B 96/02* (2006.01)
*A47K 1/05* (2006.01)
*E03C 1/02* (2006.01)

(52) U.S. Cl.
CPC ..... *A47B 96/021* (2013.01); *A47K 1/05* (2013.01); *E03C 1/021* (2013.01); *E03C 2001/028* (2013.01)

(58) Field of Classification Search
CPC ..... A47B 96/021; A47B 96/02; A47K 1/05; E03C 1/021; E03C 2001/028; A47F 10/00
See application file for complete search history.

(56) References Cited

U.S. PATENT DOCUMENTS

| | | | | |
|---|---|---|---|---|
| 1,840,033 | A | 1/1932 | Hampton | |
| 5,611,093 | A * | 3/1997 | Barnum | E03C 1/01 4/640 |
| 5,624,170 | A * | 4/1997 | Hasty | E05D 7/123 16/382 |
| 8,857,786 | B2 * | 10/2014 | Bayley | E03C 1/057 4/631 |
| 2002/0157580 | A1 | 10/2002 | Taylor | |
| 2016/0265200 | A1 * | 9/2016 | Slothower | E03C 1/057 |
| 2017/0203946 | A1 | 7/2017 | Henriquez | |
| 2020/0089262 | A1 * | 3/2020 | Wales | E03C 1/0412 |

FOREIGN PATENT DOCUMENTS

| | | |
|---|---|---|
| CN | 2283404 | 6/1998 |
| CN | 2889242 | 4/2007 |
| CN | 203016692 | 6/2013 |

(Continued)

*Primary Examiner* — Christine J Skubinna
(74) *Attorney, Agent, or Firm* — Volpe Koenig

(57) ABSTRACT

In a support part (1), it is provided that a liquid outlet (9) is to be laid with a connection line (12) in a line guide (11) within the support part (1), wherein the liquid outlet (9) opens outwards at a lower side (5) of the support part (1).

20 Claims, 10 Drawing Sheets

(56) References Cited

FOREIGN PATENT DOCUMENTS

| | | | |
|---|---|---|---|
| CN | 203784403 | | 8/2014 |
| CN | 105236500 | | 1/2016 |
| CN | 210842237 | | 6/2020 |
| DE | 102013013389 | | 2/2015 |
| EP | 2862835 | | 4/2015 |
| JP | H11169309 | | 6/1999 |
| JP | 2002004354 | | 1/2002 |
| JP | 2007263320 | | 10/2007 |
| JP | 2009153552 | | 7/2009 |
| JP | 6066161 | B2 * | 1/2017 |
| JP | 6391048 | | 8/2018 |
| WO | 2013013694 | | 1/2013 |
| WO | 2016007530 | | 1/2016 |

* cited by examiner

SUPPORT PART, CONSTRUCTION KIT FOR PIECE OF FURNITURE, PIECE OF FURNITURE AND CORRESPONDING USE

TECHNICAL FIELD

The invention relates to a support part for a piece of furniture, having an upper side and a lower side, wherein a clearance which opens toward the bottom is configured in the lower side.

The invention furthermore relates to a construction kit for a piece of furniture and to a piece of furniture.

BACKGROUND

Support parts of this type are known for example as shelf boards from system furniture and other pieces of furniture, in particular wardrobes or shelf units.

It is known for support parts of this type to be equipped with illumination means so as to achieve interesting visual effects in particular when transparent doors are used.

It is known for pieces of furniture, in particular as system furniture, to be assembled from individual parts such as support parts, for example as parts of carcasses, doors, drawers and the like. To this end, it is favorable with a view to an industrial production of the individual parts for the individual parts to form a construction kit of furniture pieces in which one and the same individual part can be used in different variants of pieces of furniture.

SUMMARY

The invention is based on the object of widening the scope of potential designs in pieces of furniture.

In order for this object to be achieved, one or more of the features described herein are provided according to the invention. In order to achieve the object in a support part of the type described at the outset it is thus in particular proposed according to the invention that a liquid outlet is inserted into the clearance, and that a line guide, in which at least one connecting line to the liquid outlet is disposed, is configured in the support part. It is advantageous here that a manner which is simple in terms of construction is described for integrating a water-conducting functionality in a piece of furniture without the furniture piece per se having to be water-resistant. To this end, the invention utilizes the fact that the support part, and the piece of furniture overall, can be protected from the liquid, in particular from water, in that at least one sealed connecting line is installed in the line guide.

One advantage of the invention lies in that a metallic main body of a fitting can be dispensed with. Weight can thus be saved, this having an advantageous effect on the transportability and/or the production costs.

The liquid outlet can be specified for dispensing water in pure form, or with additional component parts for beverages, cleaning agents, or other liquid substances.

The liquid outlet here can be configured as an elbow fitting. An inflow direction along the support part can thus be redirected to an outflow direction which is transverse to the support part.

In one advantageous design embodiment it can be provided that the support part is configured so as to be board-shaped. A compact construction mode in which the piece of furniture as per the specifications according to the invention with a water-conducting functionality does not have to have any larger dimensions can thus be achieved. The invention here has recognized that the at least one connecting line and the liquid outlet can be readily integrated in a board-shaped structure. It can in particular be provided that the support part is configured as a base insert. The liquid outlet can thus be placed in a flexible manner.

In one advantageous design embodiment it can be provided that the support part is releasably connected to a carcass of the piece of furniture. It is advantageous here that the support part is easily replaceable, for example for the purpose of maintenance, and/or that the support part can be easily retrofitted. For example, the support part can be configured as a base insert.

In one advantageous design embodiment it can be alternatively or additionally provided here that the support part is disposed so as to be movable on a carcass of the piece of furniture, for example on the already mentioned carcass. As a result, it is possible for the support part to be configured so as to be horizontally and/or vertically displaceable, for example. A horizontal displacement capability, for example similar to that of a drawer, can be advantageous in order to better fill containers with a large circumference. A vertical displacement capability can be advantageous in order to better fill containers with a large height. A displacement capability which is in each case stepless can be particularly advantageously implemented here. It is also possible for such a displacement capability to be combined with a corresponding displacement capability of a basin.

The support part can also be disposed so as to be rotatable or pivotable, for example about a horizontal or a vertical axis. This enables the configuration of a liquid-conduction functionality that can be folded out of the way. It is also possible for such a displacement capability to be combined with a corresponding displacement capability of a basin. The liquid-conducting functionality when not in use can thus be provided in a very space-saving manner.

In one advantageous design embodiment it can be provided that the support part is configured as part of a carcass of the piece of furniture. This thus describes an alternative as to how the at least one connecting line can be integrated in a simple manner without having to substantially enlarge the external dimensions.

In one advantageous design embodiment it can be provided that an activating mechanism for a valve that blocks or releases the at least one connecting line is disposed on the piece of furniture. The liquid outlet can thus be turned on and off in a simple manner. For example, the activating mechanism can be disposed on the support part. It is advantageous here that a functional unit which can be easily retrofitted or installed without special skills of the trade for connecting the water supply being required can be provided. The valve here can also be configured as a valve that switches as a function of temperature and/or as a mixing valve.

In one advantageous design embodiment it can be provided that a valve, for example the valve already mentioned, is fastened to the support part. It is advantageous here that the water-conducting functionality is fastened in a simple manner and can be installed together with the support part.

In one advantageous design embodiment it can alternatively or additionally be provided that the liquid outlet is fastened to the support part. This thus describes an alternative variant as to how the water-conducting functionality can be fixedly integratable. It is particularly favorable for the liquid outlet as well as the valve to be fastened to the support part. As a result, the at least one connecting line which can connect the valve and the liquid outlet can be relieved of strain.

In one advantageous design embodiment it can be provided that a valve, for example the valve already mentioned, is connected to the liquid outlet by way of a flexible hose. Simple installing and fastening of the valve and the liquid outlet to the support part can thus be achieved.

In one advantageous design embodiment it can be provided that the support part is made of wood and/or wood fibers, or at least externally is configured so as to be coated with wood or contain wood. Interesting possibilities in terms of the design for example in the kitchen or bathroom sector are thus opened up. For example, the support part can be made of a composite material, in particular of WPC (wood/plastic composite, a wood/polymer composite material).

The support part can also be made of sheet metal, metal, ceramic, acrylic and/or a polymer, for example in a sandwich construction mode, in particular in combination with a wood-containing component. The support part may also be machined, cast and/or be made as a glue-laminated part. It is thus possible to produce robust furniture.

In one advantageous design embodiment it can be provided that the at least one connecting line is disposed between the upper side and the lower side. It can be provided here, for example, that the at least one connecting line is disposed so as to be obscured. A surface on which the at least one connecting line is disposed can thus be utilized for further purposes, for example as a storage surface, and/or be designed in a visually appealing manner and/or be easy to clean.

In one advantageous design embodiment it can be provided that the line guide is machined into the support part. The line guide is thus able to be produced by machine and/or in an industrial manufacturing process.

In one advantageous design embodiment it can be provided that the line guide is disposed between two boards that form the upper and lower side. It can be provided here that the line guide is configured in a structural cavity, for example in a honeycomb structure or in a lamellar structure. The invention utilizes the fact that cavities in a lightweight structure can be utilized for the at least one connecting line and accessories.

In one advantageous design embodiment it can be provided that an activating mechanism, for example the activating mechanism already mentioned, has a pilot valve by way of which the valve as the primary valve is actuatable. Turning on and off can thus be carried out in a simple manner using a minor activation force. The invention here utilizes the fact that an activation force using a pilot valve can be reinforced by a pressure of water bearing thereon.

In one advantageous design embodiment it can be provided that at least one control line of the pilot valve is disposed in a control line guide in the support part. The pilot valve can thus be disposed so as to be spaced apart from the primary valve, for example outside the support part. For example, a plurality of control lines can be provided so as to form a mixing valve.

In one advantageous design embodiment it can be provided that an activation element leads outward from the valve or a pilot valve, for example the pilot valve already mentioned, in support part. This can be provided, for example, by way of a mechanical, magnetic or electric, in particular inductive, capacitive or galvanic, coupling.

Alternatively or additionally, it can be provided that the activation element leads outward on a lateral age of the support part. The activation element is thus placed so as to be readily accessible.

In one advantageous design embodiment it can be provided that the liquid outlet is a water outlet. A guide for water can thus be configured.

In particular for forming a piece of system furniture in which a user can perform assembling himself/herself, one preferred use provides a construction kit for a piece of furniture having at least one support part according to the invention, in particular as described above and/or according to one of the claims directed toward a support part. Assembling can thus easily be performed outside of a manufacturing site, even by a person without skills of the trade. A modular system in which a standardized support part having the water-conducting functionality can be used in different pieces of furniture, for example with different installation heights, can thus also be formed.

A piece of furniture having at least one support part according to the invention, in particular as described above and/or according to one of the claims directed toward a support part, can thus be formed by way of the invention. This enables a water-conducting functionality to be integrated in the space-saving manner in pieces of furniture such as, for example, bookshelves, and separate basins and the like can be dispensed with. This can be advantageously used in particular when furnishing a tightly limited living space.

In one advantageous design embodiment it can be provided in the piece of furniture that a basin is disposed below the support part. A discharge of existing water can thus also be easily integrated in the piece of furniture. A vanity or a washbasin can thus be easily integrated in a common piece of furniture.

In one advantageous design embodiment, it can be provided in the piece of furniture that the support part is disposed so as to be height-adjustable on the piece of furniture. An exit height, for example above a basin, can thus be easily integrated.

In one advantageous design embodiment it can be provided in the piece of furniture that the valve is able to be connected to a water retrieval point by way of a line which is installed in or behind a wall of the piece of furniture. A water supply can thus be easily hidden from the user. For example, it can be provided that the line is installed in a rear wall or behind a rear wall, for example on the latter. The invention here utilizes the fact that there is often sufficient space for receiving the line on the rear wall or in the rear wall. The line can thus easily be routed to the floor. From there, said line can be connected to a water retrieval point, for example an angle valve.

One preferred application provides the use of a support part according to the invention, in particular as described above and/or according to one of the claims directed toward a support part, of a piece of furniture for receiving and fastening a water outlet and at least one connecting line. A water-resistant embodiment of the support part or of other parts of the piece of furniture is thus not required.

BRIEF DESCRIPTION OF THE DRAWINGS

The invention will now be described in more detail by means of exemplary embodiments but is not limited to these exemplary embodiments. Further exemplary embodiments are derived by combining the features of individual or a plurality of claims and/or with individual or a plurality of features of the exemplary embodiments.

In the figures.

DETAILED DESCRIPTION

FIGS. 1 to 5 show an exemplary embodiment according to the invention and will be described collectively.

Figure 13:
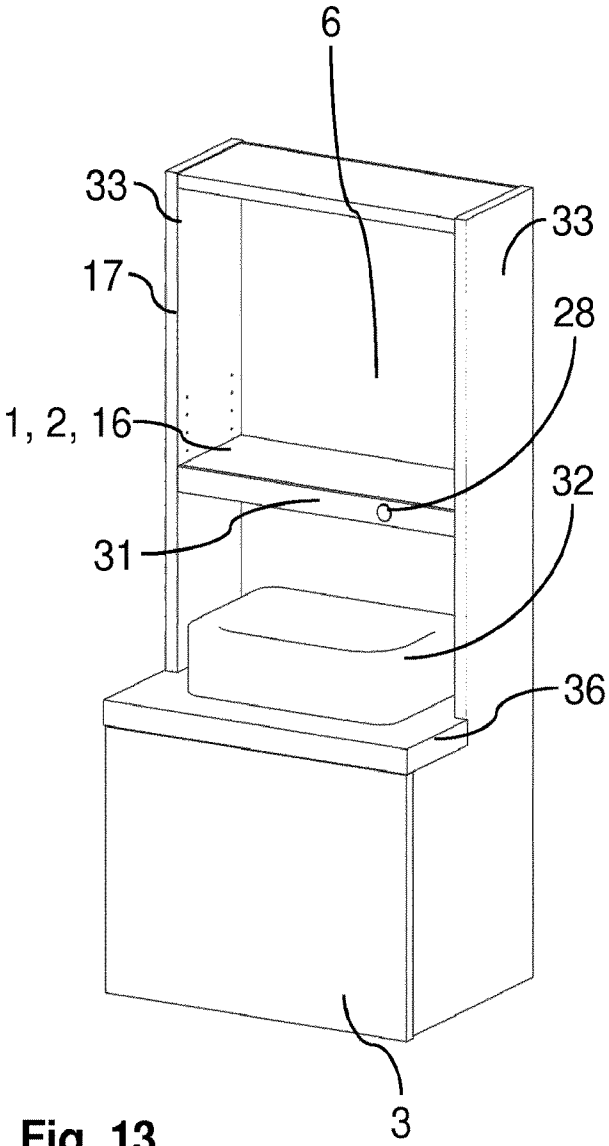
FIG. 13 shows a support part according to the invention, disposed so as to be height-adjustable on a piece of furniture.

A support part 1 according to the invention, here in an exemplary manner designed as a shelf board 2, is configured as part of a piece of furniture 3 (cf. FIG. 13).

The support part 1 has an upper side 4 and a lower side 5 which may be defined by their position when in use. The upper side is configured on an upper part 6 while the lower side 5 is configured on a lower part 7.

A clearance 8 is configured on the lower side 5.

Figure 16:
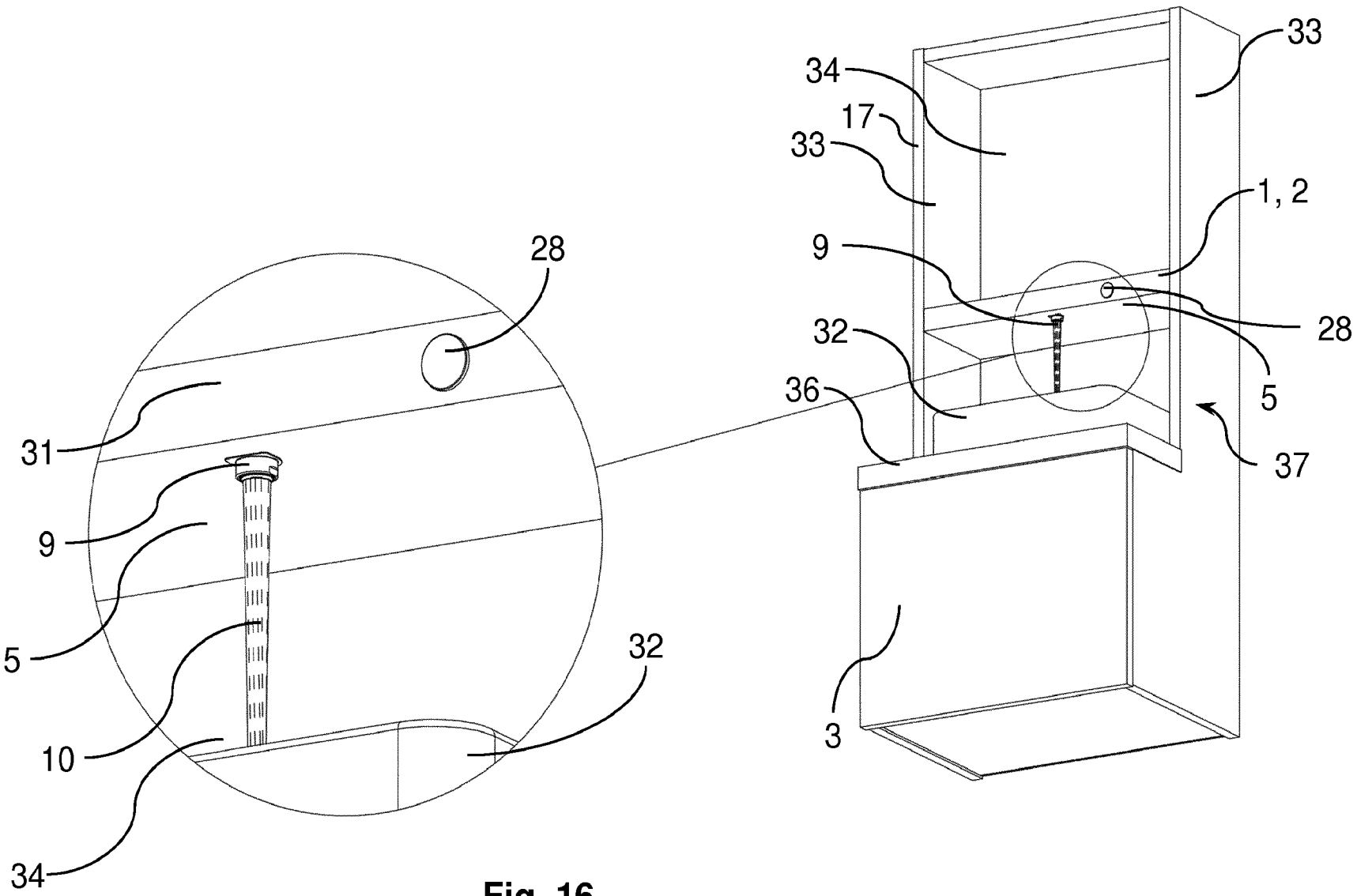
FIG. 16 shows a functional illustration of the intended use of the invention in an overall view (right) and an enlargement of a detail (left).

A liquid outlet 9 which is directed downwards such that water 10 can flow out perpendicularly toward the lower side is disposed in the clearance 8 (cf. FIG. 16).

A line guide 11 into which at least one connecting line 12 is placed is incorporated in the support part 1. The liquid outlet 9, for supplying water, is connected to the at least one connecting line 12.

The liquid outlet 9 in the exemplary embodiment is configured as an elbow fitting 13. The elbow fitting 13 redirects an inflow direction 14, which between the upper side 5 and the lower side 5 runs parallel to said sides, to an outflow direction 15.

Figures 10, 11, 12:
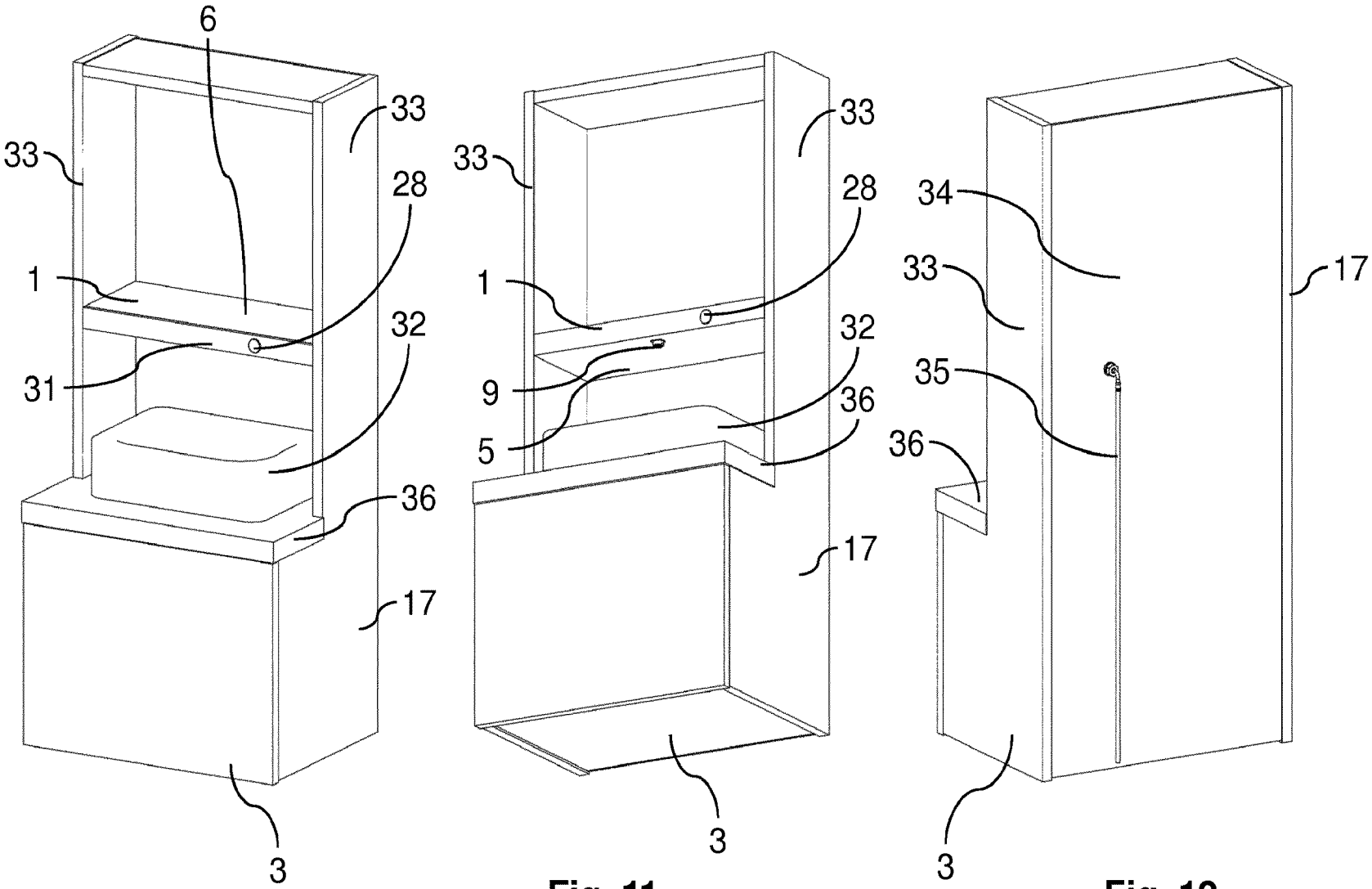
FIG. 10 shows a support part according to the invention in a piece of furniture in a view from obliquely above.
FIG. 11 shows the piece of furniture from FIG. 10 in a view from obliquely below.
FIG. 12 shows the piece of furniture from FIG. 10 in a view from the rear.

FIGS. 10 to 12 show the potential use of the support part 1 on a piece of furniture 3.

The support part 1 is configured as a base insert 16 which is inserted into a carcass 17 of the piece of furniture 3. In further exemplary embodiments the support part 1 is configured as part of the carcass 17, for example as part of side wall or of an upper side or of a lower side or of a stabilizing wall between the upper side and the lower side.

It can be seen in FIGS. 1 to 5 that an activating mechanism 18 by way of which a valve 19 can be activated is disposed on the support part 1.

The valve 19 is connected to a flexible hose 20 which at the other end of the latter opens into the liquid outlet 9 and thus forms the at least one connecting line 12.

The liquid outlet 9 and the valve 19 here are fastened to the support part 1 as a result of which the hose 20 is relieved of stress.

Figure 1:
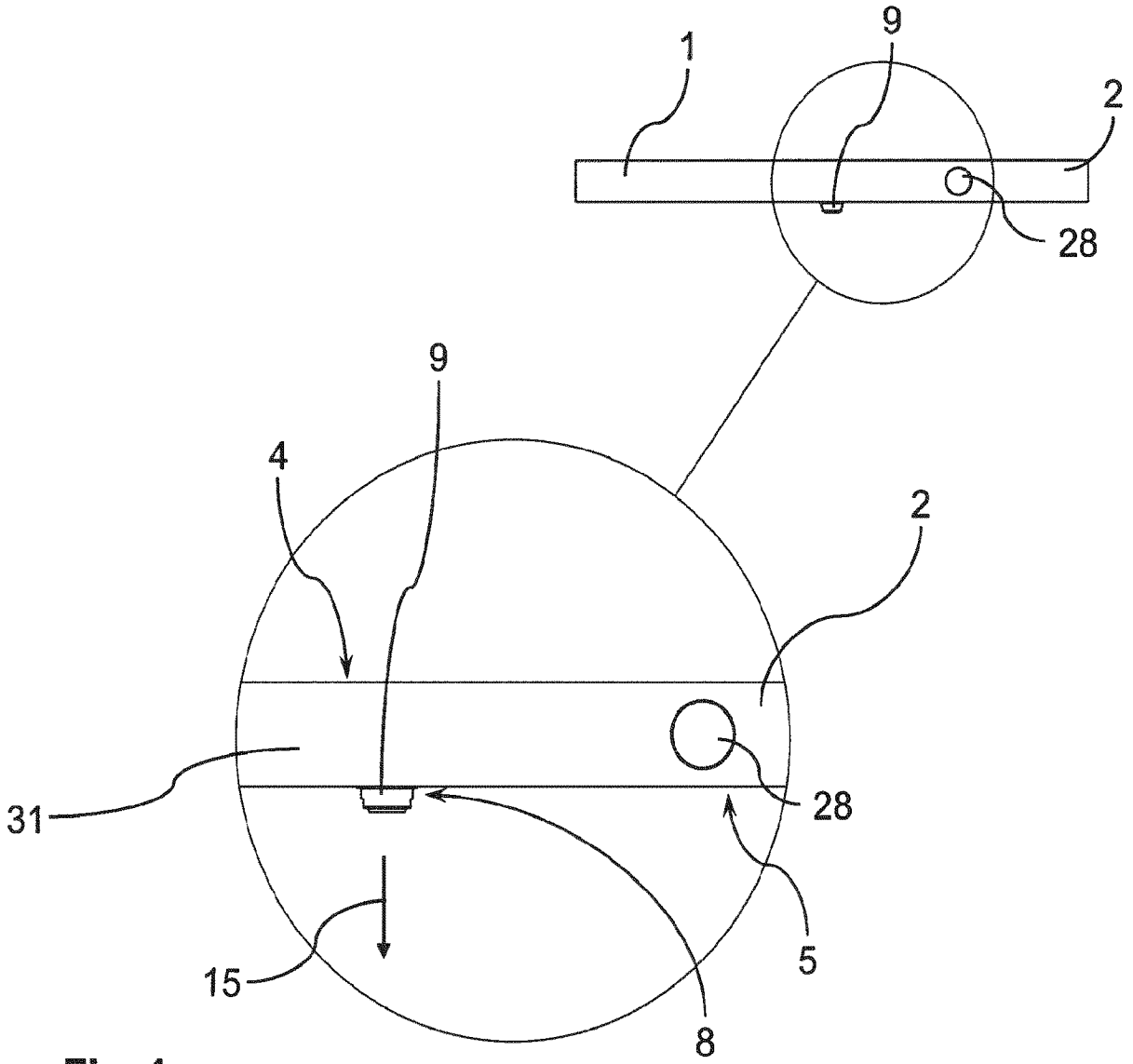
FIG. 1 shows a support part according to the invention in a view onto the front lateral edge, with a detailed illustration.
Figure 2:
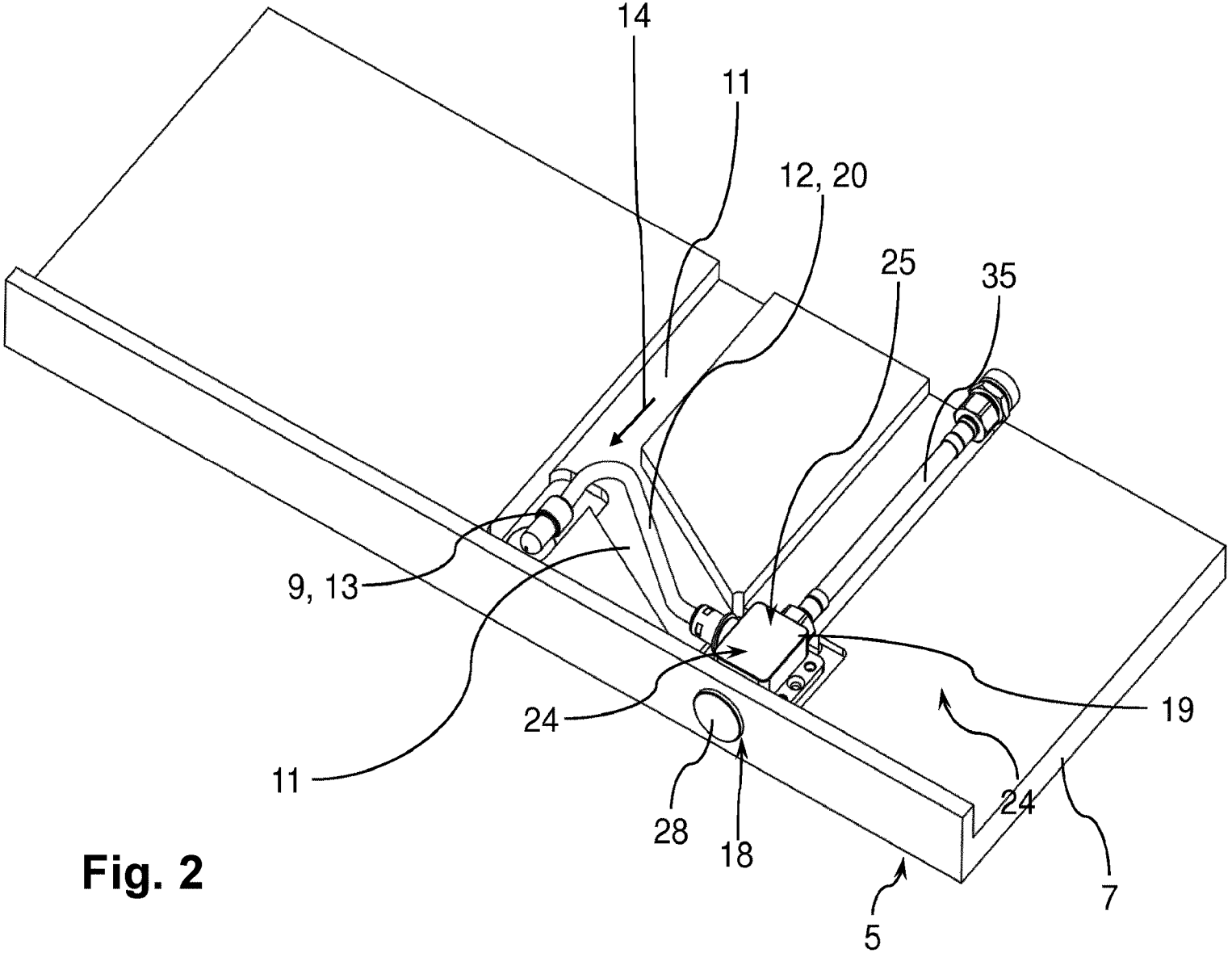
FIG. 2 shows the support part from FIG. 1 with the upper side removed.
Figure 3:
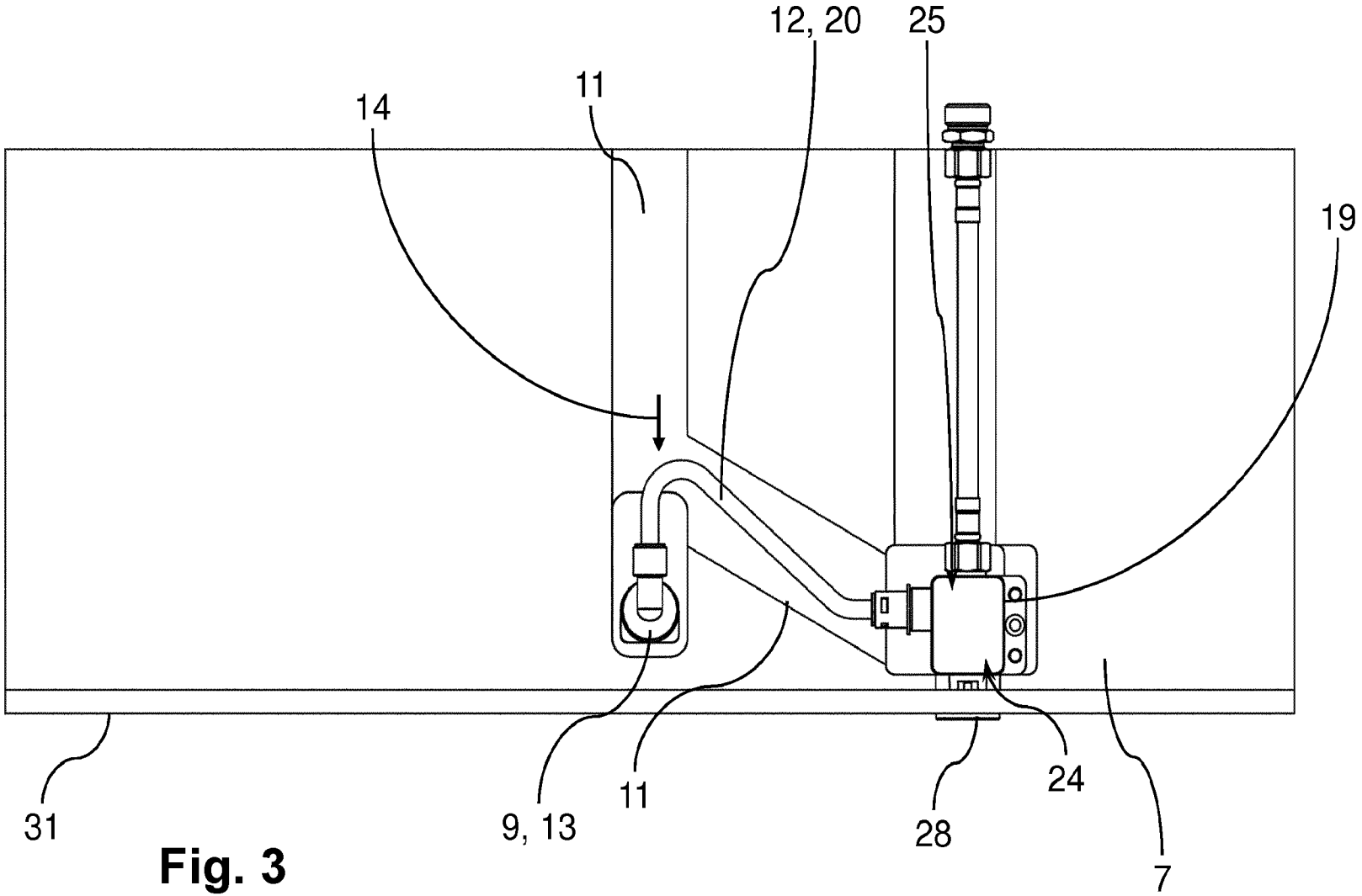
FIG. 3 shows the support part according to FIG. 2 in a plan view from above.
Figure 4:
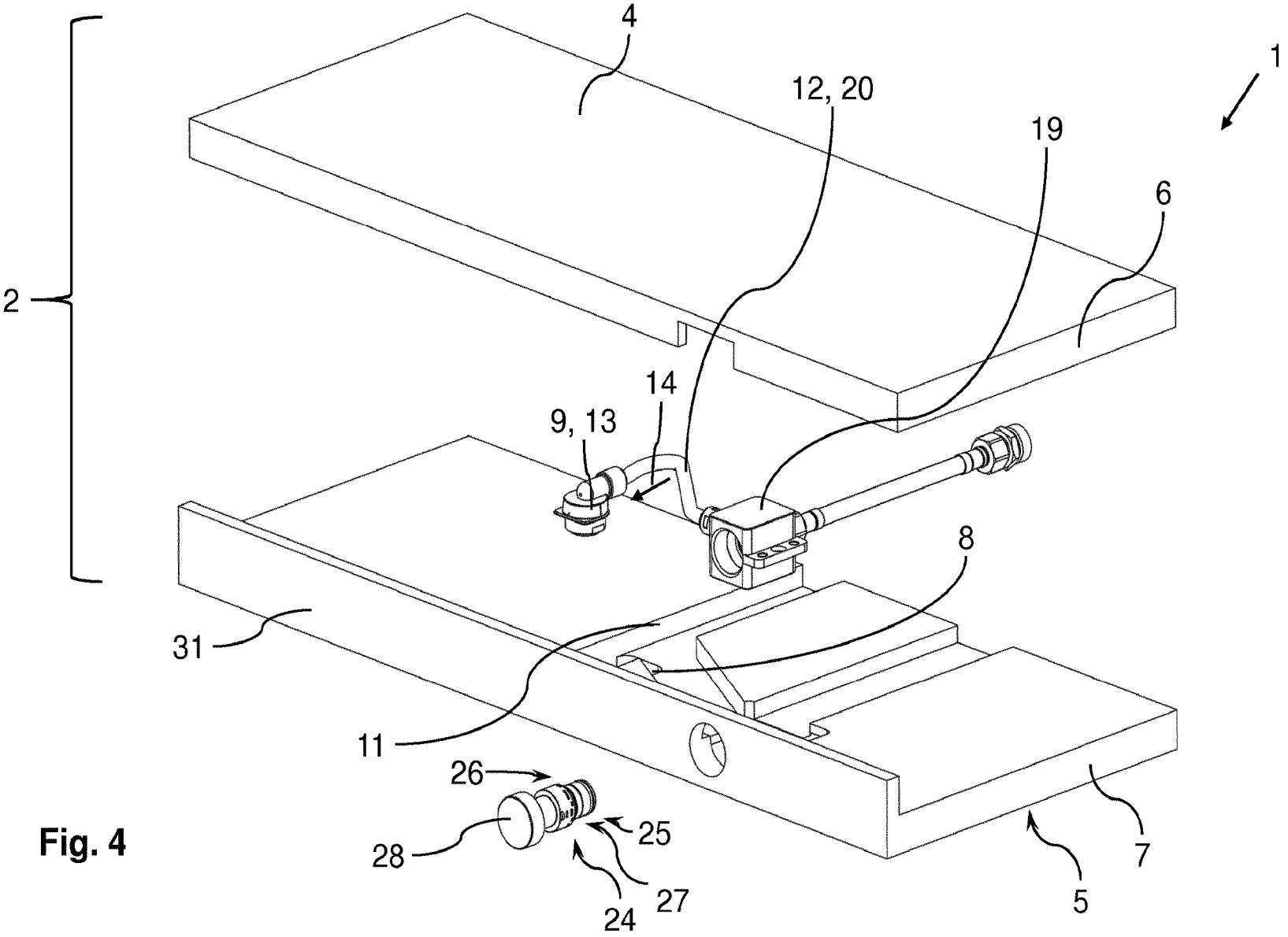
FIG. 4 shows the support part from FIGS. 1 to 3 in an exploded illustration viewed obliquely from above toward the front.
Figure 5:
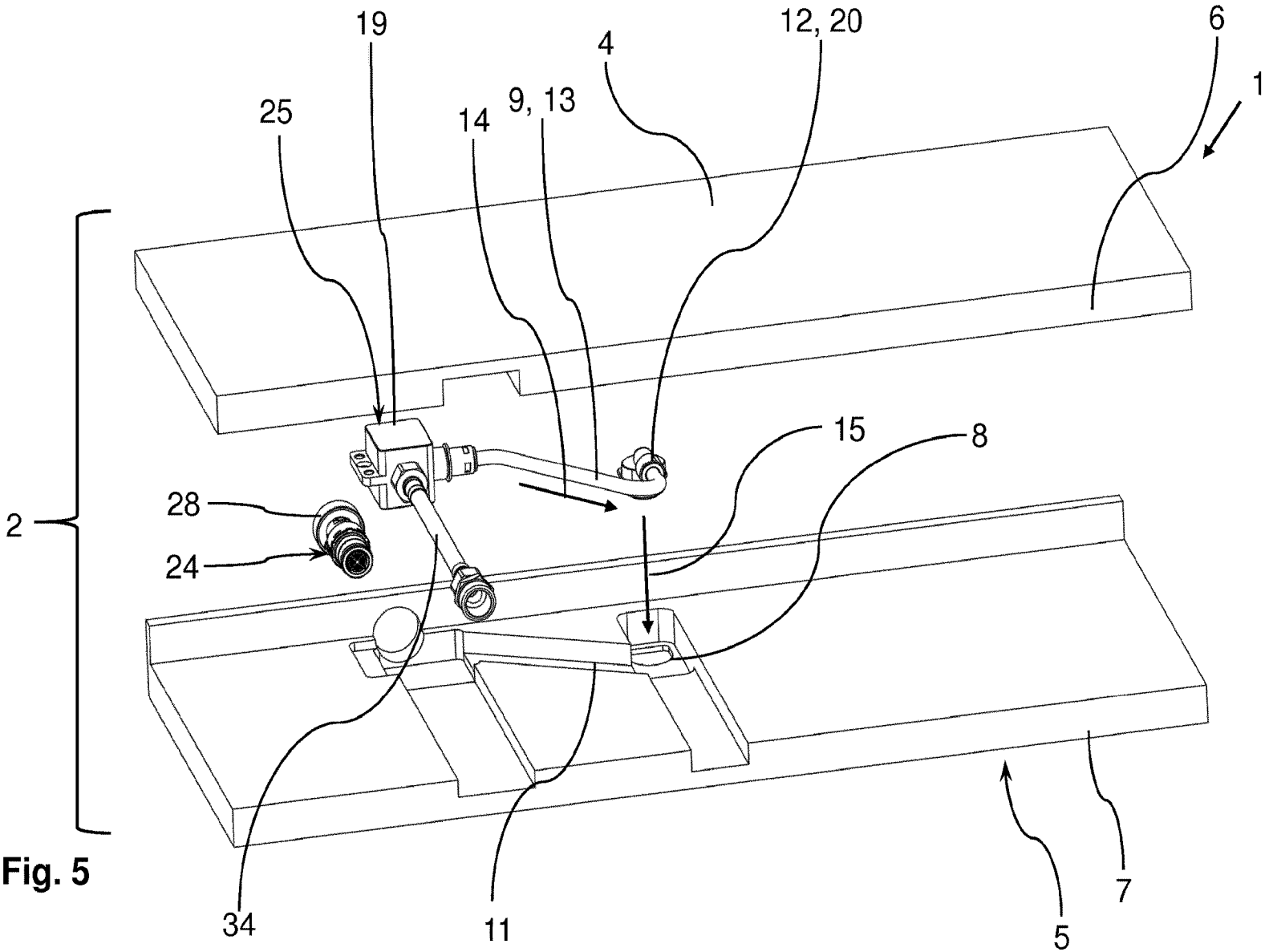
FIG. 5 shows the design embodiment according to FIG. 4 in an exploded illustration viewed obliquely from above toward the rear.
Figure 6:
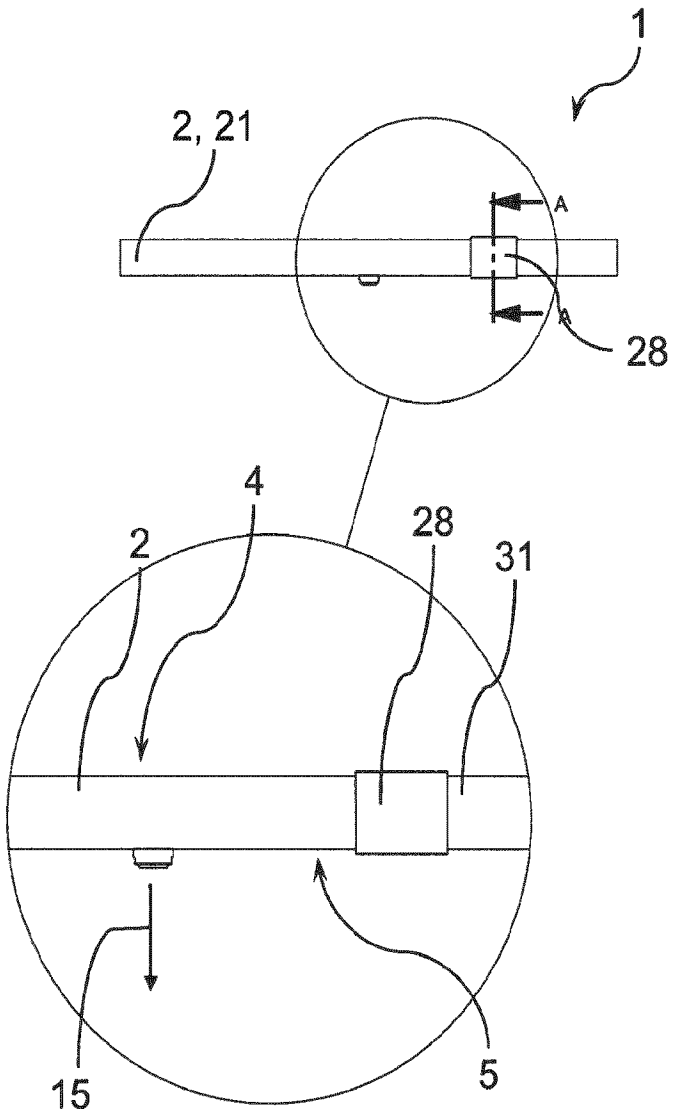
FIG. 6 shows a further support part according to the invention in a view from the front (upper half of the image) and in a detailed illustration (lower image half)
Figure 8:
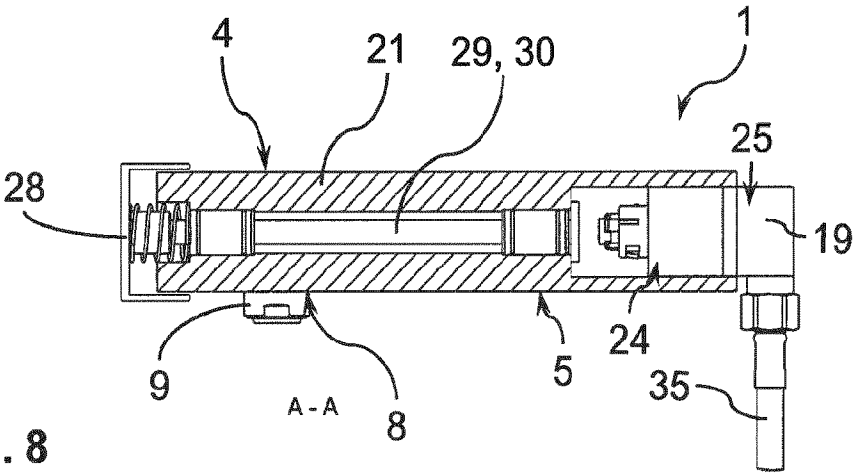
FIG. 8 shows the support part from FIG. 6 in a vertical section.
Figure 7:
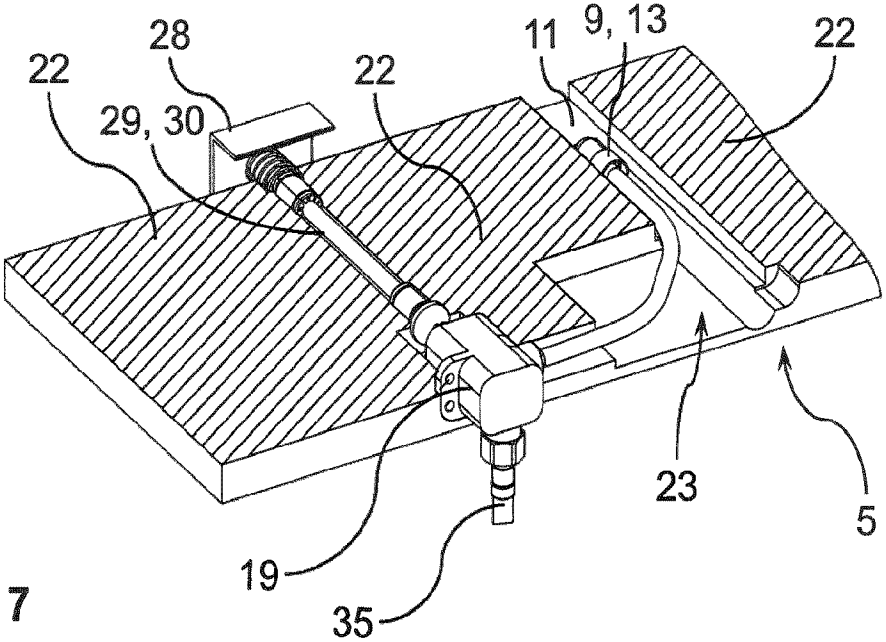
FIG. 7 shows the support part according to FIG. 6 in a horizontal section.
Figure 9:
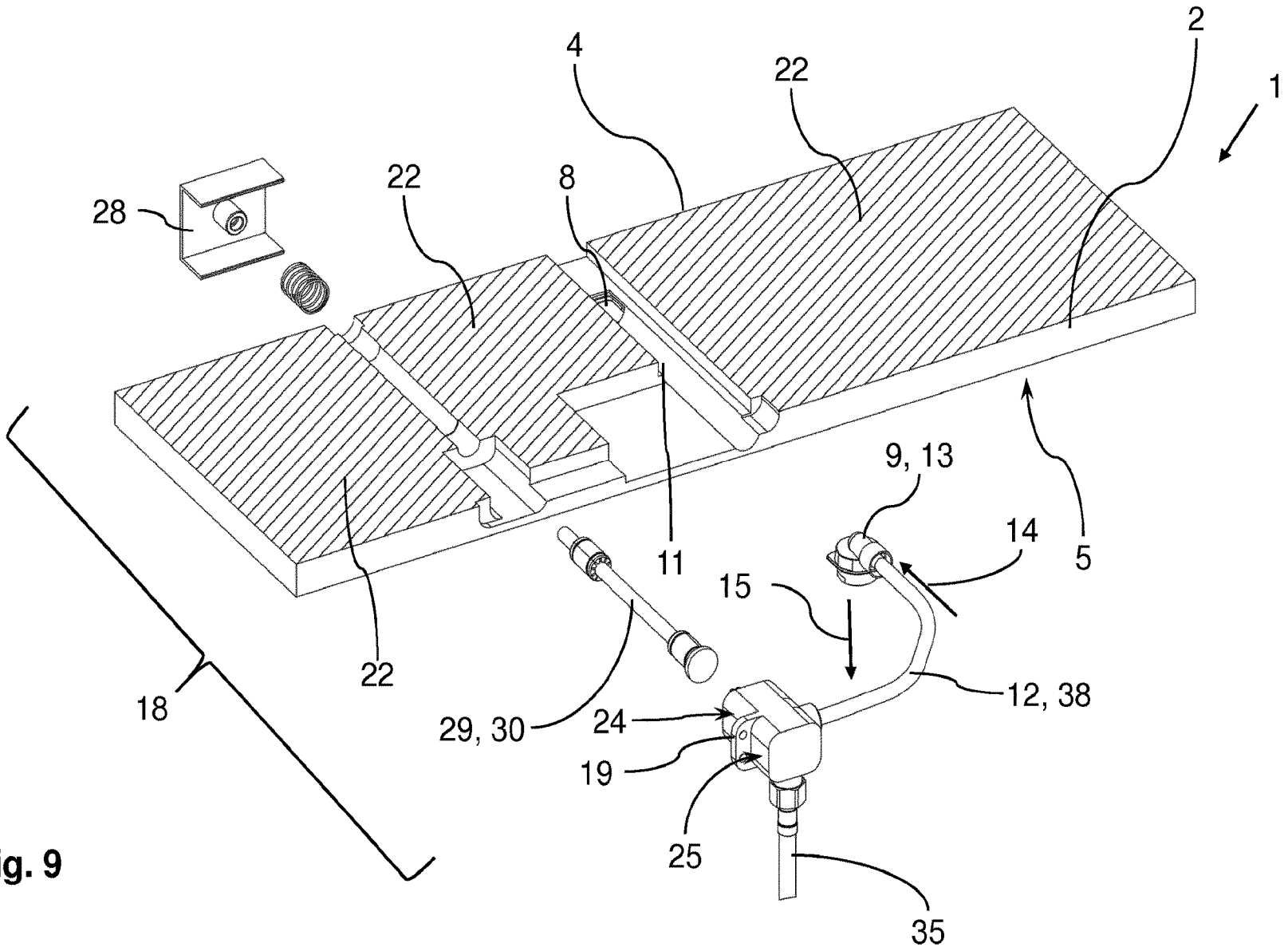
FIG. 9 shows the cut-away view of the support part from FIG. 7 in an exploded illustration.

FIGS. 6 to 8 show a further support part 1 according to the invention. Components and functional units which in terms of construction and/or function are equivalent or identical to the preceding exemplary embodiment are identified by the same reference signs and are not specially described once again.

The support part 1 as per FIGS. 6 to 8 is made in a manner known per se as a board 21 in a lightweight construction mode, having a honey structure 22 or a lamellar structure in the interior. The lightweight construction here leaves inner voids 23 for configuring the line guide 11 and for receiving the liquid outlet 9, the at least one connecting line 12, the activating mechanism 18 and the valve 19.

The board 21 can also be configured from solid wood or the like, wherein the voids 23 are machined into said board 20.

The at least one connecting line 12 is configured as a rigid pipe 38. In further exemplary embodiments, the at least one connecting line 12 is configured as a flexible hose.

The valve 19, in a manner known per se, has a pilot valve 24 by way of which a primary valve 25 is actuatable. To this end, the primary valve 25 has a membrane which, as a function of a switched position of the pilot valve 24, is actuatable by way of a water pressure which bears on the primary valve 25. To this end, a control line 26 by way of which water, in a manner known per se, can be directed into or out of a pressurized chamber 27 which is delimited by the membrane, can be configured in the interior of the valve 19. The control line 26 here can be configured as a relief opening in the membrane already mentioned. In further exemplary embodiments, the at least one control line is configured as a separate control line.

The pilot valve 24 can be activated by way of an activation element 28 of the activating mechanism 18.

FIGS. 1 to 5 show the case in which the activation element 28 is configured directly on the pilot valve 24.

FIGS. 6 to 8 show the case in which the activation element 28 is mechanically coupled to the pilot valve 24 by way of a mechanical coupling 29, here a control rod 30.

In further exemplary embodiments, the activation element 28 is coupled to the valve 19 in other ways, for example by way of a Bowden cable or a gearbox.

In the exemplary embodiment shown, the activation element 28 is configured on a front lateral edge 31 of the support part 1. In further exemplary embodiments, the activation element 28 is disposed on the upper side, the lower side and/or any other lateral edge.

The support parts 1 shown and described form in each case part of a construction kit for a piece of furniture by way of which a piece of furniture 3 as per one of FIGS. 4 to 16 can for example be formed.

A basin 32 can in each case be configured here below the liquid outlet 9.

The carcass 17 has in each case lateral walls 33 and a rear wall 34. A line 35 is routed through the wall 34.

The valve 19 by way of the line 35 can thus be connected to a water retrieval point, for example a fitting or an angle valve, not illustrated in more detail here.

Figure 14:
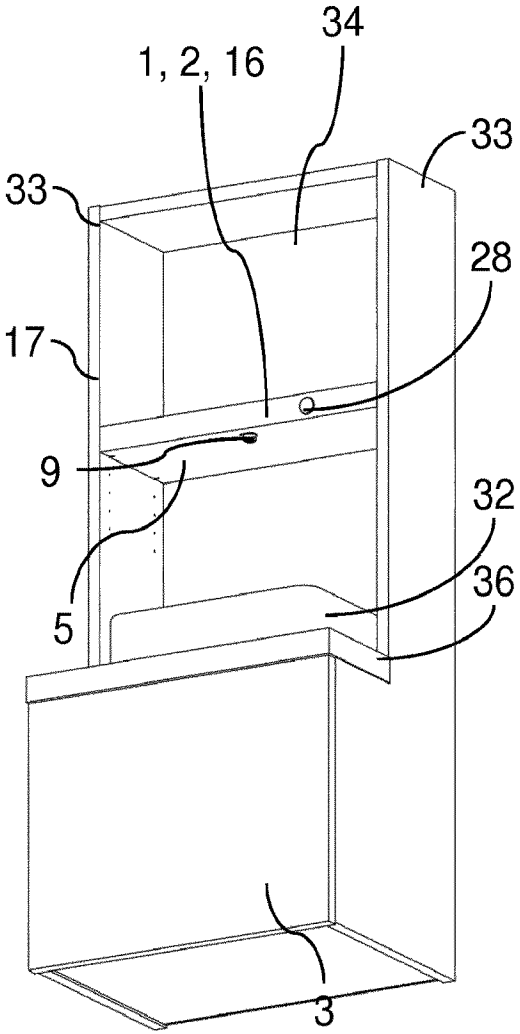
FIG. 14 shows the piece of furniture from FIG. 13, wherein the support part is disposed in another position on the piece of furniture, in a view from obliquely below.

FIGS. 13 and 14 show the case in which the support part 1 as a base insert 16 can be fastened to the carcass 17 at various heights. Here too, a FIG. 12, the line 35 can be routed out of the rear wall 34.

In one exemplary embodiment, a hole can to this end be incorporated in the rear wall 34 at the matching position of the base insert 16 during assembly, for example by drilling or breaking out a predetermined breaking point.

In a further exemplary embodiment, the rear wall 34 can be assembled from a plurality of individual parts, wherein one individual part is configured with a hole and other individual parts are configured without a hole, for example. By choosing the dimensions of the individual parts in a corresponding manner, it can be achieved that the hole can be placed in various positions when the individual parts are assembled in different ways.

In a further exemplary embodiment, the rear wall 34 can be configured in two parts, having an upper and a lower part, wherein the upper part can be pushed up like a roller shutter, and the lower part can be pushed down like a roller shutter. A separating line between the parts can thus be vertically displaced so as to enable the line 35 to be routed out at the separating line for all positions of the support part 1.

In a further exemplary embodiment, the rear wall 34 can be configured in multiple parts, having at least two stationary parts which therebetween leave a window, and a horizontally displaceable part which covers the window and overlaps the stationary parts. Adapting the position of the hole to the position of the support part can again take place if the hole is incorporated in the horizontally movable part.

In further exemplary embodiments, combinations of these possibilities are implemented.

Figure 15:
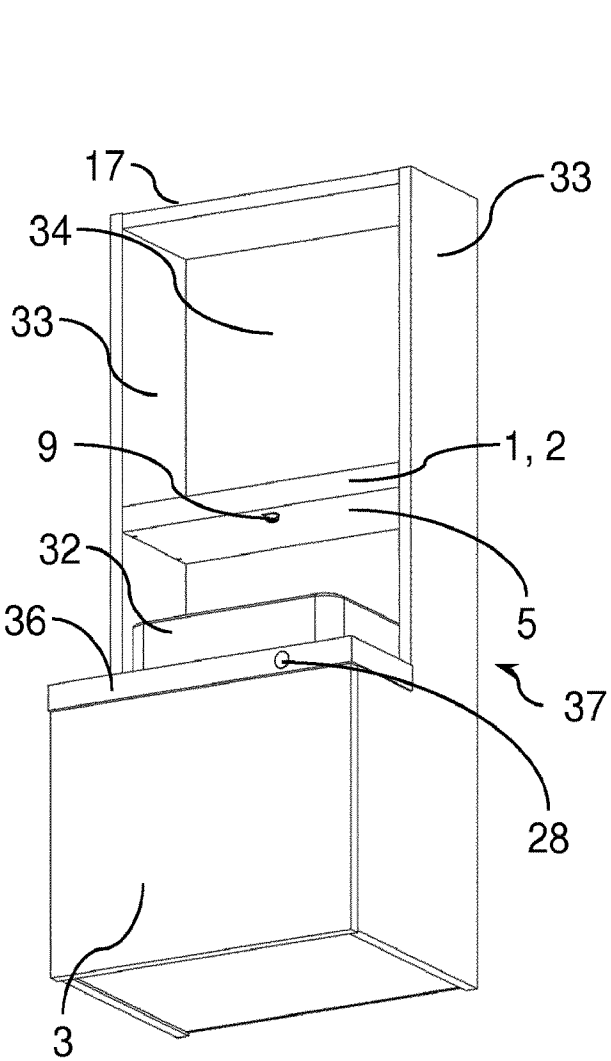
FIG. 15 shows a support part according to the invention with remote activation.

In the exemplary embodiment as per FIG. 15, the activation element 28 is not disposed on the support part 1 but so as to be remote from the latter, for example in a vanity tabletop 36.

The activation element 28 here can be coupled to the pilot valve 24 by way of a mechanical coupling 29 or any other, for example electronic, coupling. Alternatively, the pilot valve 24 may be separate from the primary valve 25 and connected to the latter by way of a control line 26. The pilot valve 24 here can be disposed directly on the activation element 28.

The control line 26 can be disposed in a control line guide 37, for example on the rear side, which may be configured in a manner analogous to that of the line guide 11.

The valve 19 here can overall be disposed in the support part 1 and coupled to the activation element 28.

Alternatively, the valve 19 can be disposed in or on the vanity tabletop 36, or in or on the basin 32, and be connected to the liquid outlet 9 by way of a long connecting line 12.

Alternatively, the primary valve 25 can be disposed in the support part 1, and the pilot valve 24 can be disposed outside the support part 1, for example in or on the vanity tabletop 36, or in or on the basin 32. The pilot valve 24 here is operatively connected to the primary valve 25 by way of the control line 36.

In further exemplary embodiments, the support part 1 is configured as a base of the carcass 17, and the piece of furniture 3, for use, is disposed above a basin or a bathtub or a shower tray.

In the case of a support part 1 according to the invention, it is thus proposed that a liquid outlet 9 having at least one connecting line 12 is installed in a line guide 11 in the interior of the support part 1, wherein the liquid outlet 9 opens to the outside on a lower side 5 of the support part 1.

LIST OF REFERENCE SIGNS

1 Support part
2 Shelf board
3 Piece of furniture
4 Upper side
5 Lower side
6 Upper part
7 Lower part
8 Clearance
9 Liquid outlet
10 Water
11 Line guide
12 Connecting line
13 Elbow fitting
14 Inflow direction
15 Outflow direction
16 Base insert
17 Carcass
18 Activating mechanism
19 Valve
20 Hose
21 Board
22 Honeycomb structure
23 Void
24 Pilot valve
25 Primary valve
26 Control line
27 Pressurized chamber
28 Activation element
29 Mechanical coupling
30 Control rod
31 Lateral edge
32 Basin
33 Wall
34 Rear wall
35 Line
36 Vanity tabletop
37 Control line guide
38 Pipe

The invention claimed is:

1. A support part (1) for a piece of furniture (3), the support part comprising:

a part having an upper side (4) and a lower side (5), with a clearance (8) which opens toward a bottom configured in the lower side (5);

a liquid outlet (9) inserted in the clearance (8); and a line guide (11) configured within the support part (1), wherein at least one connecting line (12) is arranged in the line guide (11), and wherein the line guide (11) is formed in the support part (1), the at least one connecting line (12) is inserted into the line guide (11) and the liquid outlet (9) is connected to the at least one connecting line (12).

2. The support part (1) as claimed in claim 1, wherein the support comprises at least one of a base insert (16), or a component that is at least one of releasably connected to a carcass (17) of the piece of furniture (3)-or is disposed on the carcass (17) so as to be movable.

3. The support part (1) as claimed in claim 1, wherein the support part (1) is configured as part of a carcass (17) of the piece of furniture (3).

4. The support part (1) as claimed in claim 1, further comprising a valve (19) and an activating mechanism (18) for the valve (19) disposed on the piece of furniture (3).

5. The support part (1) as claimed in claim 1, wherein at least one of a valve (19) or the liquid outlet (9) is fastened to the support part (1).

6. The support part (1) as claimed in claim 1, wherein the support part (1) is at least one of made from wood, made from wood fibers, coated externally with wood, or contains wood.

7. The support part (1) as claimed in claim 1, wherein at least one of (a) the at least one connecting line (12) is disposed between the upper side (4) and the lower side (5), or (b) the line guide (11) is machined into the support part (1).

8. The support part (1) as claimed in claim 1, wherein the line guide (11) is disposed between two boards (21) that form the upper side and the lower side (5).

9. The support part (1) as claimed in claim 4, wherein the activating mechanism (18) has a pilot valve (24) by which the valve (19) as the primary valve (25) is actuatable.

10. The support part (1) as claimed in claim 9, further comprising at least one control line (26) for the pilot valve (24) that is disposed in a control line guide (37) in the support part (1).

11. The support part (1) as claimed in claim 9, wherein an activation element (28) leads outward from the valve (19) or from the pilot valve (24) in the support part (1) via a mechanical coupling (29).

12. The support part (1) as claimed in claim 1, wherein the liquid outlet is a water outlet.

13. A construction kit for a piece of furniture, having at least one support part (1) as claimed in claim 1.

14. A piece of furniture (3) having at least one support part (1) as claimed in claim 1, and the support part (1) is horizontally disposed.

15. The piece of furniture (3) as claimed in claim 14, further comprising a basin (32) disposed below the support part (1), and the support part (1) is disposed so as to be height-adjustable on the piece of furniture (3).

16. The piece of furniture (3) as claimed in claim 14, further comprising a valve (19) that is adapted to be connected to a water retrieval point by a line (35) which is installed in or behind a wall (33) of the piece of furniture (3).

17. A support part (1) for a piece of furniture (3), the support part comprising:

a part having an upper side (4) and a lower side (5), with a clearance (8) which opens toward a bottom configured in the lower side (5);

a liquid outlet (9) inserted in the clearance (8); and a line guide (11), in which at least one connecting line (12) to the liquid outlet (9) is disposed, configured in the support part (1), wherein the support part comprises a shelf board (2).

18. The support part (1) as claimed in claim 4, wherein the valve comprises at least one of a valve that switches as a function of the temperature, a mixing valve, or a valve that blocks or releases the at least one connecting line (12).

19. The support part (1) as claimed in claim 1, further comprising a valve (19) connected to the liquid outlet (9) by a flexible hose (20).

20. A support part (1) for a piece of furniture (3), the support part comprising:

a part having an upper side (4) and a lower side (5), with a clearance (8) which opens toward a bottom configured in the lower side (5);

a liquid outlet (9) inserted in the clearance (8); and a line guide (11), in which at least one connecting line (12) to the liquid outlet (9) is disposed, configured in the support part (1), wherein the line guide (11) is disposed in a honeycomb structure (22) between the upper side and the lower side.

* * * * *